United States Patent [19]

Firey

[11] Patent Number: 4,698,069

[45] Date of Patent: Oct. 6, 1987

[54] CYCLIC GAS WITH SOLID REACTION PLANT

[76] Inventor: Joseph C. Firey, P.O. Box 15514, Seattle, Wash. 98115-0514

[21] Appl. No.: 856,808

[22] Filed: Apr. 28, 1986

[51] Int. Cl.[4] ..... C10J 3/00; C10J 3/22

[52] U.S. Cl. ..... 48/61; 48/86 R; 48/DIG. 6; 123/3; 123/23; 60/39.12; 60/39.17

[58] Field of Search ..... 48/61, 63, 64, 76, 86 R, 48/197 R, 203, 206, DIG. 6; 422/110, 111, 116, 149, 193; 123/1 R, 3, 23, 25 R, 64; 60/39.04, 39.12, 39.17

[56] References Cited

U.S. PATENT DOCUMENTS

| | | | |
|---|---|---|---|
| 974,087 | 10/1910 | Low . | |
| 1,586,508 | 5/1926 | Brutzkus . | |
| 1,733,623 | 10/1929 | O'Connor | 48/203 |
| 1,913,395 | 6/1933 | Karrick | 48/DIG. 6 |
| 1,992,323 | 2/1935 | Ranney | 48/DIG. 6 |
| 2,172,124 | 9/1939 | Gilbert | 123/24 |
| 2,225,311 | 12/1940 | Lysholm | 60/39.04 |
| 2,396,524 | 3/1946 | Nettel | 123/23 |
| 2,624,172 | 1/1953 | Houdry | 60/39.04 |
| 2,625,141 | 1/1953 | Berlyn | 123/25 |
| 2,675,672 | 4/1954 | Schörner | 60/39.17 |
| 2,714,670 | 8/1955 | Linder et al. | 60/39.12 |
| 3,734,184 | 5/1973 | Scott | 48/DIG. 6 |
| 3,981,277 | 9/1976 | Abom | 123/23 |
| 4,047,901 | 9/1977 | Baron et al. | 48/86 R |
| 4,059,078 | 11/1977 | de la Rosa | 123/25 K |
| 4,085,578 | 4/1978 | Kydd | 60/39.02 |
| 4,204,506 | 5/1980 | Bowling | 123/23 |
| 4,310,490 | 1/1982 | Ruskan et al. | 422/188 |
| 4,323,370 | 4/1982 | Leitgeb | 55/18 |
| 4,412,511 | 11/1983 | Firey | 123/23 |
| 4,429,669 | 2/1984 | Burley | 123/64 |
| 4,455,837 | 6/1984 | Firey | 60/39.01 |
| 4,484,531 | 11/1984 | Firey | 110/342 |
| 4,509,957 | 4/1985 | Firey | 48/DIG. 6 |
| 4,533,362 | 8/1985 | Firey | 48/DIG. 6 |

FOREIGN PATENT DOCUMENTS

| | | | |
|---|---|---|---|
| 3042313 | 6/1982 | Fed. Rep. of Germany | 123/64 |
| 11475 | 6/1847 | United Kingdom | 123/24 |
| 492831 | 9/1938 | United Kingdom | 60/39.17 |

*Primary Examiner*—David L. Lacey

[57] ABSTRACT

Reactant gas reservoir systems are described in combination with solid with gas reaction plants using cyclic compression and expansion of the reactant gas. During compression reactant gases are stored in the reservoir system. During expansion these stored reactant gases emerge from the reservoir systems to react with gaseous products formed from the solid reactant during compression.

6 Claims, 3 Drawing Figures

CYCLIC GAS WITH SOLID REACTION PLANT

CROSS REFERENCES TO RELATED APPLICATIONS

The invention described herein is useable on the chemical reactor machines described in my following U.S. patent applications:

(1) Solid With Gas Reactor Plant, Ser. No. 06/791798, filed Oct. 28, 1985.

(2) Cyclic Solid Gas Reactor, Ser. No. 06/473566, filed Mar. 9, 1983, now standing allowed with the issue fee paid. Now issued as U.S. Pat. No. 4,584,970 as of Apr. 29, 1986.

The chemical reactor machines described in these cross-referenced U.S. patent applications are also cyclic solid with gas reaction plants, as defined herein in the description of the prior art, and differ from the listed prior art machines primarily in utilizing more than one cycle of compression and expansion after introducing fresh reactant gases, before removing product reacted gases.

BACKGROUND OF THE INVENTION

1. Field of the Invention:

This invention is in the field of chemical reactor machines for reacting one or more porous solid reactants with one or more gaseous reactants, wherein compression of gaseous reactants into the pore spaces of the solid reactant is followed by expansion of the resultant product gases out of these pore spaces, and this cycle of compression and expansion is repeated.

2. Description of the Prior Art:

Examples of prior art reactors for reacting solid reactants with gaseous reactants are described in the following U.S. patents:

U.S. Pat. No. 4,372,256, J. C. Firey, Feb. 8, 1983
U.S. Pat. No. 4,412,511, J. C. Firey, Nov. 1, 1983
U.S. Pat. No. 4,455,837, J. C. Firey, June 26, 1984
U.S. Pat. No. 4,484,531, J. C. Firey, Nov. 27, 1984
U.S. Pat. No. 4,509,957, J. C. Firey, Apr. 9, 1985
U.S. Pat. No. 4,533,362, J. C. Firey, Aug. 6, 1985
U.S. Pat. No. 4,537,603, J. C. Firey, Aug. 27, 1985
U.S. Pat. No. 4,568,361, J. C. Firey, Feb. 4, 1986

In all of the above example reactors the gaseous reactants are compressed into the pore spaces of the solid reactants contained within a reaction chamber, and this is followed by expansion of the primary product reacted gases, formed by reaction of the reactant gases with the solid reactants, out of the pore spaces of the solid reactant. This cycle of compression followed by expansion is repeated, with fresh gaseous reactants being supplied for each compression and with product reacted gases being removed during each expansion. Such chemical reactors for reacting solids with gases and using this cyclic compression and expansion process are herein and in the claims referred to as cyclic solid with gas reaction plants.

The terms solid reactant, reactant gas, reacted gas are defined in the cross referenced application Ser. No. 06/473566 on page 5 line 15 through page 6 line 6 and this material is incorporated herein by reference thereto. The term changeable gas flow connection and the term fixed open gas flow connection are defined in U.S. Pat. No. 4,509,957 in column 18 line 43 through line 52 and this material is incorporated herein by reference thereto.

In many cyclic solid with gas reaction plants at least two steps of chemical reaction occur: a primary reaction between gas reactant and solid reactant during compression; a secondary reaction between the primary product reacted gas from the primary reaction and additional gas reactant during expansion. The primary reaction takes place principally within the pore spaces of the solid reactant whereas the secondary reaction takes place principally outside the pore spaces of the solid reactant. A volume or space wherein chemical reaction occurs is herein and in the claims referred to as a reaction chamber. For example, the pore spaces within the solid reactant are a primary reaction chamber, whereas any gas space outside this primary reaction chamber may be a secondary reaction chamber if secondary reactions occur there. These primary and secondary reaction chambers may be separately enclosed by the containing walls of separate pressure vessels or may be jointly enclosed within the containing walls of a single pressure vessel.

Where secondary reactions take place between primary product reacted gas and additional reactant gas during expansion, the proper mixing of these gases for complete and rapid secondary reaction cannot always be assured when only primary and secondary reaction chambers are used. For example, in the char and oil burning engines described in U.S. Pat. No. 4,412,511, when high volatile matter char fuels are used, it is important that this volatile matter be promptly mixed with air reactant as soon as it emerges from the char fuel pores during expansion in order to avoid soot formation. This mixing of air with volatile matter is described in U.S. Pat. No. 4,412,511, in column 13 lines 49 through 54, and this material is incorporated herein by reference thereto. But with only the primary reaction chamber available for this reaction and essentially filled with char fuel, most of the air reactant supplied to the primary reaction chamber during compression will be used up in the primary reaction. Hence during expansion, when the volatile matter is emerging from the char fuel pores at the refuel end of the primary reaction chamber, the air quantity available may be inadequate for proper and complete mixing and reaction with this volatile matter and soot formation may result. Such soot formation may reduce combustion efficiency and produce engine exhaust smoke.

Another example problem is seen in the secondary reaction of primary reacted gases with secondary air in a cyclic velox boiler as described in U.S. Pat. No. 4,455,837. The manner of occurrence of this secondary reaction when only primary and secondary reaction chambers are used is described in U.S. Pat. No. 4,455,837, in column 41 line 62 through column 44 line 21, and this material is incorporated herein by reference thereto. As discussed therein proper mixing and reaction of the emerging primary reacted gases with the secondary air reactant gases during expansion cannot always be assured. Rather complex gas flow control means may sometimes be required, as described, to improve this mixing and reaction.

SUMMARY OF THE INVENTION

The reactant gas reservoir systems of this invention are used in combination with a cyclic gas with solid reaction plant, using cyclic compression, and expansion, to improve the speed and completeness of the secondary reactions occurring during expansion. Gas reactants are stored in these reactant gas reservoirs during compression and this stored reactant then emerges to mix and react in the secondary reaction with primary reacted gas during expansion. The reactant gas reservoirs can be positioned so as to improve the mixing of secondary reactant gas with primary reacted gas and thus to improve the speed and completeness of the secondary reaction, and this is a beneficial object of this invention.

DESCRIPTION OF THE PREFERRED EMBODIMENTS

The reactant gas reservoir systems described herein are used to improve the operation of cyclic gas with solid reaction plants, such as those described in the description of the prior art and in the cross references to related applications. All forms of this reactant gas reservoir system invention comprise the following elements:

(1) one or more reactant gas reservoirs, which are gas space volumes each enclosed by a pressure vessel wall;

(2) means for connecting each reactant gas reservoir to one or more reaction chambers of the cyclic gas with solid reaction plant;

(3) these elements connect to and operate with a cyclic gas with solid reaction plant.

Some forms of this invention comprise elements in addition to the foregoing and some forms of this invention use modified forms of the foregoing elements. A reactant gas reservoir is defined herein and in the claims as a gas space volume enclosed by pressure vessel walls within which little or no chemical reaction occurs, and is in this way distinguished from a reaction chamber wherein appreciable chemical reaction occurs.

In operation, reactant gases are compressed via the connecting means into the reactant gas reservoir during compression and are stored therein. This stored reactant gas then flows out via the connecting means during expansion to mix and react in the secondary reaction with the primary reacted gases formed during the preceding compression in those reaction chambers containing solid reactant. By suitable design of the connecting means proper mixing of the stored reactant gas with the primary reacted gases can be secured during expansion, thus assuring rapid and complete secondary reaction, and this is one of the beneficial objects of this invention.

Figure 1:
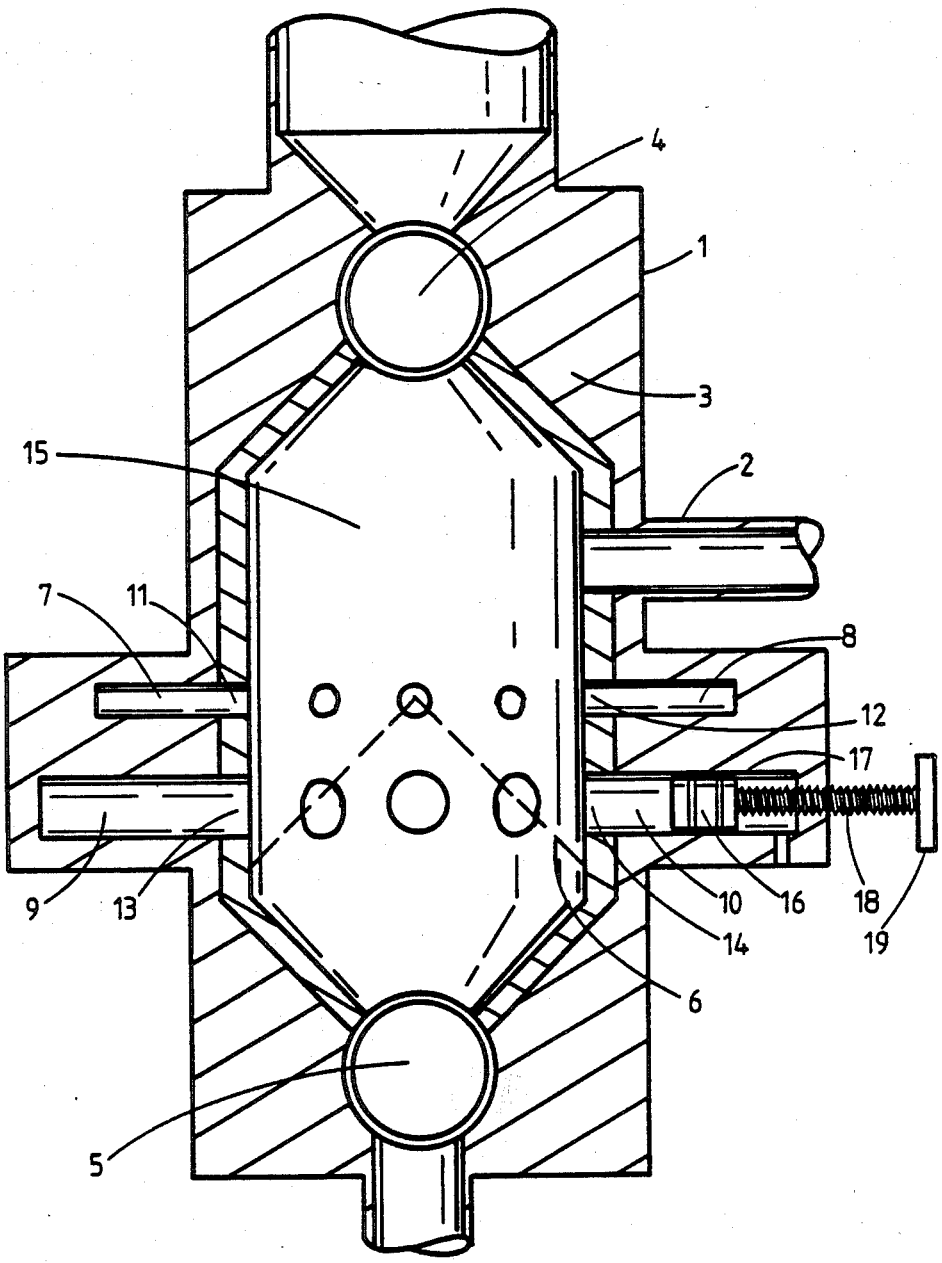
In FIG. 1 several reactant gas reservoir systems are shown as used in combination with a container reaction chamber of a cyclic velox boiler.

One example of the use of a reactant gas reservoir system of this invention with a cyclic velox boiler is shown partially in FIG. 1 and comprises:

(1) One of the containers, 1, of the cyclic velox boiler plant, connecting via the fixed open gas flow connection, 2, to the compressor, expanders and heat exchangers, etc. of the cyclic velox boiler plant. The cyclic velox boiler plant can be any of those described in U.S. Pat. No. 4,455,837, and this material is incorporated herein by reference thereto. The boiler portions of the container, 1, are not shown in FIG. 1 but only the pressure vessel, 3, the refuel means, 4, the ash removal means, 5, and the outline, 6, of the char fuel pile within the container, 1. The container, 1, is a reaction chamber wherein both primary and secondary reactions occur.

(2) Several reactant gas reservoirs, 7, 8, 9, 10, etc. are used and these connect directly via the connecting means, 11, 12, 13, 14, etc., into the container, 1. These particular connecting means are fixed open gas flow connections.

(3) Only one of the containers, 1, of the cyclic velox boiler plant is shown in FIG. 1, but each such container can be similarly equipped with reactant gas reservoirs and connecting means. The cyclic velox boiler with reactant gas reservoir system shown in FIG. 1 operates as follows:

(4) During compression air is compressed into the container, 1, via the connection, 2. Some of this air is compressed into the pore spaces within the char fuel pile, 6, and reacts therein with the char fuel to form primary reacted gas products. Other portions of this air are compressed into the internal volumes of the several reactant gas reservoirs, 7, 8, 9, 10, etc., via their connecting means, 11, 12, 13, 14, etc., and becomes stored therein during compression.

(5) During expansion primary reacted gas emerges from the char fuel pile and mixes with secondary air in the dead volume, 15, to react in the secondary reaction. Additional secondary air also flows out of the reactant gas reservoirs, 7, 8, 9, 10, etc., via their connecting means, 11, 12, 13, 14, etc. and also mixes and reacts with the emerging primary reacted gases.

(6) By locating the reactant gas reservoirs, 7, 8, 9, 10, etc., and connecting means, 11, 12, 13, 14, etc., so that the secondary air supplied by these reservoirs is directed into close contact and intimate mixing with the primary reacted gases emerging from the char fuel pile, 6, as shown in FIG. 1, good mixing and hence complete secondary reaction can be obtained. This is one of the beneficial objects of this invention.

Also shown in FIG. 1 is an example of a means for adjusting the internal volume of the reactant gas reservoir, 10, which comprises:

(7) An adjustable piston, 16, sealably moveable within the cylinder, 17, of the reactant gas reservoir, 10.

(8) Means for moving the piston, 16, comprising a threaded shaft, 18, and adjusting wheel, 19.

In this way the internal volume of the reactant gas reservoir, 10, can be adjusted so that the secondary air quantity stored therein during compression will supply the air quantity needed for complete secondary reaction with that portion of the primary reacted gas emerging from the char fuel pile, 6, adjacent to the connecting means, 14. A more efficient use of secondary air can thus be achieved by such adjustments of the volumes of the reactant gas reservoirs, and excess air losses can be minimized. Such a means for adjusting the internal volume of a reactant gas reservoir is shown only on reservoir, 10, of FIG. 1, but can be used on several or all of the reactant gas reservoirs if desired. Other means for adjusting the internal volume can alternatively be used, such as adding or subtracting capped lengths of pipe to a reservoir.

Figure 2:
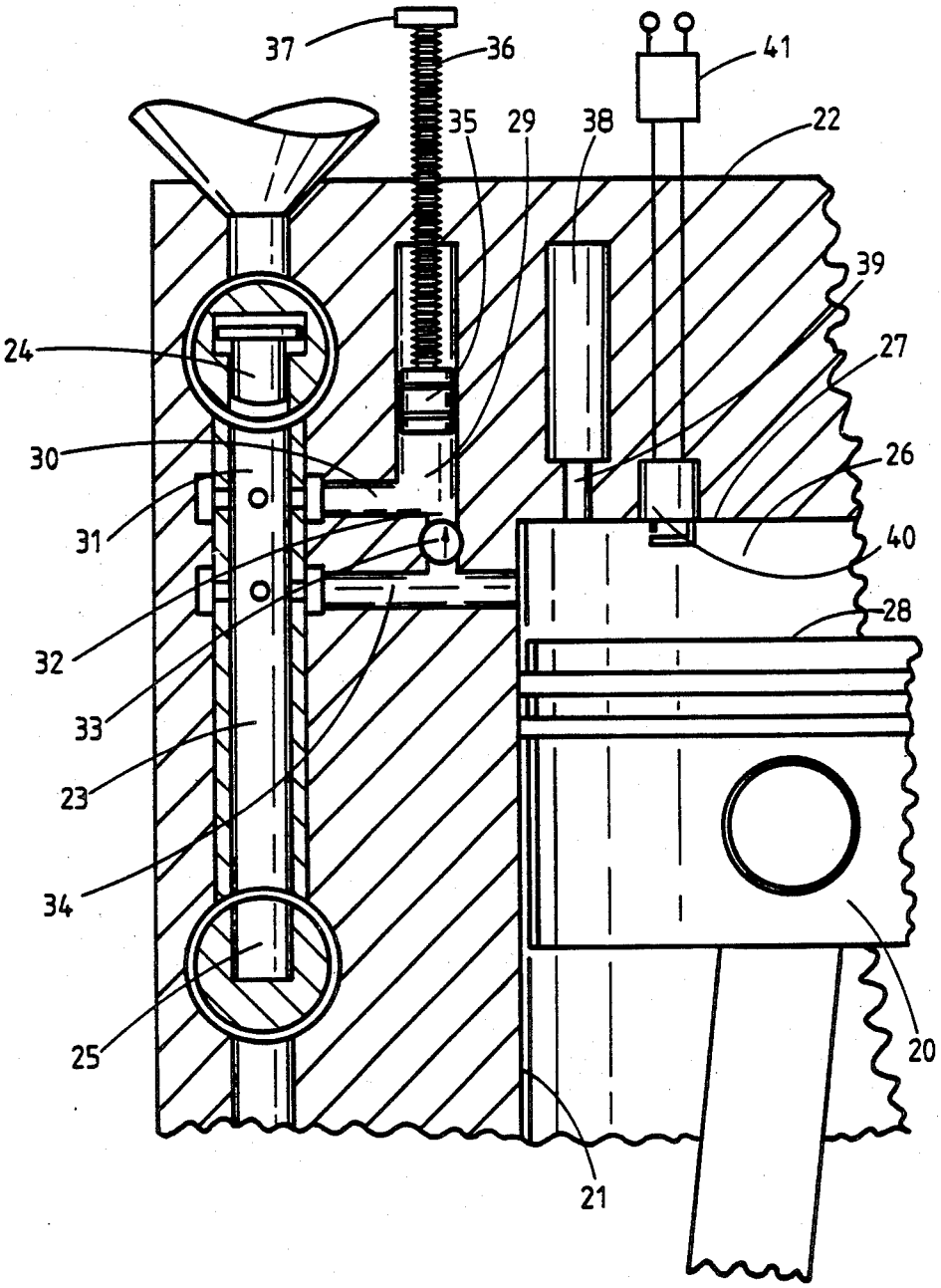
In FIG. 2 the use of reactant gas reservoir systems in combination with a char and oil burning engine is illustrated.

Another example of the use of a reactant gas reservoir systems of this invention with a char and oil burning engine is shown partially in FIG. 2 and comprises:

(1) The piston, 20, and cylinder, 21, of a char and oil burning engine, 22, are shown partially, together with the combustion chamber, 23, refuel mechanism, 24, and ash removal mechanism, 25. The char and oil burning engine can be any of those described in U.S. Pat. No. 4,412,511, and this material is incorporated herein by reference thereto. The combustion chamber, 23, is a primary reaction chamber and is filled with porous char fuel by the refuel mechanism, 24, ashes being removed therefrom by the ash removal mechanism, 25. The space between the engine cylinder head, 27, and the piston crown, 28, is a secondary reaction chamber 26 wherein the primary reacted gas, formed during compression in the combustion chamber, 23, emerges during expansion to mix and burn with secondary air in the secondary reaction chamber, 26. The primary reaction chamber, 23, connects to the secondary reaction chamber, 26, via the fixed open gas flow connection, 34.

(2) A first reactant gas reservoir system, 29, connects via the fixed open gas flow connecting means, 30, to the refuel end, 31, of the combustion chamber, 23, and also connects via the changeable gas flow connecting means, 32, which has a check valve, 33, to the secondary reaction chamber, 26. The check valve, 33, permits gas flow from the secondary reaction chamber, 26, into the reactant gas reservoir, 29, but prevents reverse flow of gas from the reservoir, 29, into the secondary reaction chamber, 26. The char and oil burning engine with reactant gas reservoir system shown in FIG. 2 operates as follows:

(3) During compression by the piston, 20, air is compressed into the combustion chamber, 23, and reacts therein with the char fuel to form primary reacted gas products. Air is also compressed into the reactant gas reservoir, 29, via the connecting means, 32, with check valve, 33, and is stored therein during compression.

(4) During expansion primary reacted gas emerges from the combustion chamber, 23, and flows into the secondary reaction chamber, 26, via the connection, 34, to mix and react with the secondary air contained therein. Air from the reactant gas reservoir, 29, flows via the connection, 30, into the refuel end, 31, of the combustion chamber, 23, and there mixes with the volatile matter being distilled out of the freshly refueled char fuel and emerging from the char fuel pores during expansion. By thusly mixing air into the emerging volatile matter clean and efficient burning of the volatile matter can be obtained, and this is one of the beneficial objects of this invention. Air from the reactant gas reservoir, 29, is prevented from expanding back directly into the secondary reaction chamber, 26, by the check valve, 33, and is thus compelled to flow into the refuel end, 31, of the combustion chamber, 23, as desired.

A check valve, 33, is used in FIG. 2 to make the connecting means, 32, a changeable gas flow connection but other valves could be used to achieve the same results, such as a timed mechanically driven valve. The use of such changeable gas flow connections causes the reactant gas reservoir to be connected to a different combination of reaction chambers during expansion than it was connected to during compression. For example, in FIG. 2 the reactant gas reservoir, 29, is connected to both the primary reaction chamber, 23, and the secondary reaction chamber, 26, during compression, but is connected to only the primary reaction chamber, 23, during expansion. Of the two connecting means, 32, 30, shown in FIG. 2 for the reservoir 29, only one, connection, 32, is a changeable gas flow connecting means, but in some applications it may be preferred that each reactant gas reservoir have more than one changeable gas flow connection to more than one reaction chambers.

Also shown in FIG. 2 is another example of a means for adjusting the internal volume of the reactant gas reservoir, 29, essentially similar to that described hereinabove, and comprising an adjustable piston, 35, with threaded adjusting shaft, 36, and adjusting wheel, 37. When the volatile matter content of the char fuel being used is increased, more air is needed in the reactant gas reservoir, 29, to assure proper burning of this volatile matter, and this volume adjustment means can be used to secure this result.

Additionally shown in FIG. 2 is a second reactant gas reservoir system, 38, connecting to the secondary reaction chamber, 26, via the fixed open gas flow connection, 39. During compression air is also stored in this second reactant gas reservoir, 38. During expansion this stored air emerges from the reservoir, 38, via the connecting means, 39, and mixes and reacts with the primary reacted gases in the secondary reaction in reaction chamber, 26. In some applications a means for initiating reaction between primary reacted gas and secondary reactant gas during expansion may be needed. An example of one such means for initiating reaction is shown as a spark plug, 40, and spark energizer, 41, in FIG. 2. The reaction initiating spark could be continuous or intermittent as only during expansion. Other reaction initiating means, such as pilot flames or hot spots, can also be used for these purposes.

During expansion of a container and reaction chamber of a cyclic velox boiler of U.S. Pat. No. 4,455,837, those primary reacted gases first emerging from the char fuel pile will find a short supply of secondary air available to them from expansion of the dead volume unless sufficient excess air is placed into the dead volume. This excess air is then not subsequently useable as a reactant and reduces plant efficiency in part by increase of exhaust enthalpy losses. This excess secondary air supply problem is discussed in U.S. Pat. No. 4,455,837 in column 41 line 62 through column 43 line 50 and the consequent least amount of excess air needed to assure complete secondary reaction of the emerging primary reacted gases is described in column 50 lines 40 through 47. This unused excess air quantity can be reduced, and hence plant efficiency increased, by using a reactant gas reservoir system of this invention, comprising a means for adjusting the internal volume of the reactant gas reservoir. The means for adjusting the reactant gas reservoir internal volume is modified so that reservoir volume is decreased during the first part of expansion in order to furnish the extra air needed by the first emerging primary reacted gases. Subsequently reactant gas reservoir volume is increased during compression in order to store up the extra air needed for the next expansion. This cycle of decreasing reactant gas reservoir volume during early expansion and increasing reactant gas reservoir volume during compression is continuously repeated while the plant is operating.

Figure 3:
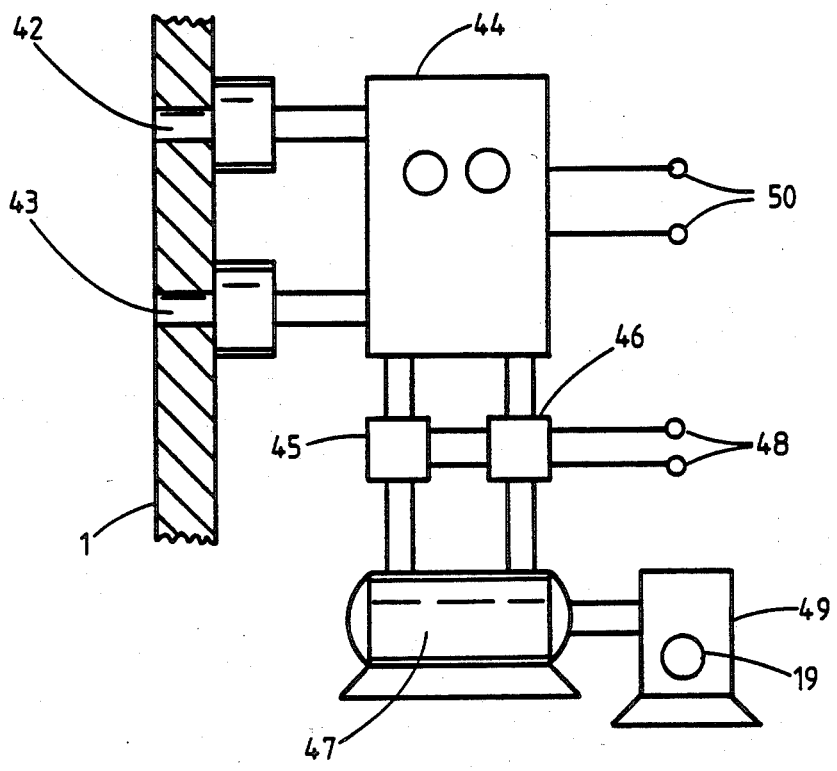
In FIG. 3 is shown a control means for adjusting the internal volume of a reactant gas reservoir.

The reactant gas reservoir, 10, of FIG. 1 is fitted with a means for adjusting the internal volume, 16, 18, 19, of the reservoir and the adjusting wheel, 19, can be driven to decrease reservoir volume during the early part of expansion, and to then increase reservoir volume during compression by a control means, one example of which is shown schematically in FIG. 3. The example control means of FIG. 3 comprises the following:

(1) A reaction chamber pressure sensor, 42, mounted on the wall of the reaction chamber, 1.

(2) A reaction chamber rate of change of pressure sensor, 43, also mounted on the wall of the reaction chamber, 1.

(3) The signals from both the pressure sensor, 42, and the rate of change of pressure sensor, 43, are inputs to a controller, 44, whose output actuates either the increase switch, 45, or the decrease switch, 46, of the reversible electric motor, 47.

(4) The reversible electric motor, 47, when energized from the power source, 48, via the increase switch, 45, drives the adjusting wheel, 19, of FIG. 1, via the worm reduction gear, 49, so as to increase the internal volume of the reactant gas reservoir, 10.

(5) The reversible electric motor, 47, when energized from the power source, 48, via the decrease switch, 46, drives the adjusting wheel, 19, of FIG. 1, via the worm reduction gear, 49, so as to decrease the internal volume of the reactant gas reservoir, 10.

During early expansion reaction chamber pressure is high and reaction chamber rate of change of pressure is negative, i.e., the pressure is decreasing. When these signals are received by the controller, 44, from the sensors, 42, and, 43, the controller actuates the decrease switch, 46, and the extra secondary air then desired is supplied since reactant gas reservoir volume is being decreased. During early compression reaction chamber pressure is low and reaction chamber rate of change of pressure is positive, i.e., the pressure is increasing. When these signals are received by the controller, 44, from the sensors, 42, and, 43, the controller actuates the increase switch, 45, and the reactant gas reservoir volume is then increased in order to store up the extra secondary air needed for the start of the next expansion. The controller is energized via the power source, 50. This cycle of decreasing reactant gas reservoir volume during early expansion followed by increasing reactant gas reservoir volume during compression is continuously repeated by the action of the control scheme shown in FIG. 3.

Only one of the reactant gas reservoirs, 10, of FIG. 1 is shown with a means for adjusting the internal volume but more than one or all of the reactant gas reservoirs can be so equipped if desired and these can be similarly controlled to decrease and increase in volume during expansion and compression as described hereinabove.

Having thus described my invention, what I claim is:

1. In a cyclic gas with solid reaction plant for reacting gases with solid reactants and comprising: at least two reaction chambers; said at least two reaction chambers being connected to one another; at least one of said at least two reaction chambers containing at least one solid reactant; at least one other of said at least two reaction chambers being free of said at least one solid reactant; means for cyclically compressing all of said at least two reaction chambers concurrently with at least one reactant gas, followed by concurrently expanding primary product reacted gases, formed by reaction of said at least one solid reactant with said at least one reactant gas and unreacted gas reactant; wherein the improvement comprises including in said cyclic gas with solid reaction plant a reactant gas reservoir system comprising:

at least one reactant gas reservoir;

means for connecting each of said at least one reactant gas reservoir to at least one of said at least two reaction chambers so that at all times each said at least one reactant gas reservoir has an open gas flow connection to at least one of said at least two reaction chambers.

2. A cyclic gas with solid reaction plant as described in claim 1; wherein said means for connecting each of said at least one reactant gas reservoirs to at least one of said at least two reaction chambers are fixed open gas flow connections.

3. A cyclic gas with solid reaction plant as described in claim 2; and further comprising means for adjusting the internal volume of at least one of said at least one reactant gas reservoirs.

4. A cyclic gas with solid reaction plant as described in claim 2; wherein each said at least one reactant gas reservoir is connected to but one of said at least two reaction chambers by said means for connecting.

5. A cyclic gas with solid reaction plant as described in claim 1; wherein said means for connecting each of said at least one reactant gas reservoirs to at least one of said at least two reaction chambers comprises at least one changeable gas flow connecting means which connects each said at least one reactant gas reservoir to a different combination of said at least two reaction chambers during expansion than it was connected to during compression.

6. A cyclic gas with solid reaction plant as described in claim 5; and further comprising means for adjusting the internal volume of at least one of said at least one reactant gas reservoir.

* * * * *